United States Patent [19]

Wu

[11] Patent Number: 4,810,520

[45] Date of Patent: Mar. 7, 1989

[54] METHOD FOR CONTROLLING ELECTROLESS MAGNETIC PLATING

[75] Inventor: Cherng-Dean Wu, Richfield, Minn.

[73] Assignee: Magnetic Peripherals Inc., Minneapolis, Minn.

[21] Appl. No.: 100,317

[22] Filed: Sep. 23, 1987

[51] Int. Cl.[4] ..... B05D 5/12

[52] U.S. Cl. ..... 427/8; 427/128; 427/132

[58] Field of Search ..... 427/8, 128, 132

[56] References Cited

U.S. PATENT DOCUMENTS

| | | | |
|---|---|---|---|
| 2,584,816 | 2/1952 | Sands | 204/231 |
| 3,950,234 | 4/1976 | Faulkner et al. | 204/43 |
| 4,108,739 | 8/1978 | Tadokoro et al. | 204/40 |
| 4,132,605 | 1/1979 | Tench et al. | 204/195 |
| 4,310,389 | 1/1982 | Harbulak | 204/129 |
| 4,472,248 | 9/1984 | Koskenmaki | 204/43 |
| 4,631,116 | 12/1986 | Ludwig | 204/434 |

*Primary Examiner*—Bernard Pianalto

*Attorney, Agent, or Firm*—Bill D. McCarthy

[57] ABSTRACT

An improved method for controlling magnetic quality of electroless plating in which the plated substrates are subjected to magnetic film deposition for a true plating time determined by offsetting the total plating time by the activation time, the activation time being the time for surface potential transients to decrease and steady state surface potential to occur.

5 Claims, 4 Drawing Sheets

(●) 75°C, pH 8.05; (○) 85°C, pH 8.05; (□) 85°C, pH 8.2; (△) 85°C, pH 7.8

METHOD FOR CONTROLLING ELECTROLESS MAGNETIC PLATING

BACKGROUND OF THE INVENTION

1. Field of the Invention

The present invention relates generally to plating and methods of controlling the quality of the plating process, and more particularly but not limited to, a method of controlling electroless deposition of magnetic plating films.

2. Discussion of Prior Art

Plating methods for memory disks in general can be divided into two categories: electrolytic plating (electroplating) and electroless plating. Electroless plating differs to that of electroplating in that no electric current is involved in the deposition process. The driving force for the reaction is supplied by the reducing agent in the solution. A chemically reduced reaction proceeds spontaneously only in the direction of an overall lower Gibbs free energy if the temperature is high enough to overcome the activation energy barrier. Thus, conventional regulation of the rate of electroless plating is achieved by maintaining constant temperature. The rate of reactions cannot be precisely monitored and controlled due to the difficulty caused by temperature fluctuations. In contrast thereto, current input into an electroplating system can be adjusted to any desired level.

It is known that plating is extremely sensitive to the surface conditions of the substrate being plated. The variations on a disk substrate, such as cleanliness, roughness, etc., are critical to the yield distribution in magnetic deposition. The control in the yield distribution of magnetic properties of an electroless cobalt plated thin film on a disk substrate is therefore a great challenge in the manufacture of magnetic disks.

With regard to such magnetic disks, chemically deposited Co-P films have been long recognized as one of the magnetic layers for high density storage. The deposition process often utilized is electroless plating which basically involves Co(II) reduction by hypophosphite ions at the interface between the substrate and plating solution. This phenomenon is heterogeneous in nature, and the plating kinetics and the properties of the plated films are influenced by the surface conditions of the substrate and the structure of the double-layer across the interface. It is known that the magnetic properties of the resulting Co-P films are a complicated function of phosphorous content, crystalline size and thickness, which in turn are controlled by plating variables, primarily bath formula, pH and temperature. perature.

Since the interfacial properties vary significantly to those in the solution bulk, it is difficult to precisely regulate the plating process and therefore the magnetics. A parameter which reflects the system as a whole and is easily monitored for better process control is highly desirable.

SUMMARY OF THE INVENTION

The present invention provides for improved yield control of magnetic plating of an electroless plating process comprising the steps of determining the activation time of the bath by measuring the time required to reach steddy state surface potential, and by subjecting a selected plating substrate to a true plating time determined to occur subsequent to the activation time.

That is, by measuring the surface potential it can be determined when potential transients cease and when a steady state potential occurs in an electroless plating bath in which Co-P film is deposited. Once the steady state surface potential is reached, this potential jump is an indicator that true plating has commenced. By determining the plating time for a selected substrate based on true plating time, which is the total plating time less the activation time, greater yield control of the deposited substrates is achieved.

Accordingly, an object of the present invention is to provide an improved method to control electroless deposition of magnetic films.

Yet another object, while achieving the above stated object, is to provide a electroless plating parameter which is easily measured and monitored for greater yield control of magnetic plating.

Other objects, features and advantages of the present invention will be apparent from the following description when read in conjunction with the appended claims and drawings.

BRIEF DESCRIPTION OF THE DRAWINGS

FIG. 6A is a graphic depiction of $B_r$-t of electroless plating as a function of total time of electroless Co-P plating, while FIG. 6B is similar except as a function of true plating time.

FIG. 7A depicts distribution of polarity versus the remanence-thickness product for electroless Co-P plating of six samples plated simultaneously and which were interconnected electrically, while

DESCRIPTION

The present invention is the result of work performed to study the effects of various parameters on the quality of magnetic properties achieved in an electroless deposition process. It is believed that a discussion of these findings may assist in a better understanding of the benefits of the present invention which involves measurement of transient surface potential to achieve a narrower yield distribution of film magnetics by adjusting the plating time in the manner described hereinbelow.

Magnetic thin films (approximately 2 microinches thick) of Co-P were made on aluminum-based Ni-P disk substrate material by electroless plating using the following Co-P magnetic bath composition:

TABLE I

| Reagent | Bath Formula g/l | M (mole/l) |
|---|---|---|
| Borate, $Na_2B_4O_7.10H_2O$ | 31.91 | 0.084 |

TABLE I-continued

| Reagent | Bath Formula g/l | M (mole/l) |
|---|---|---|
| Citrate, $Na_3C_6H_5O_7.2H_2O$ | 39.99 | 0.136 |
| Cobalt, $CoSO_4.7H_2O$ | 12.74 | 0.045 |
| Hypo-, $NaH_2PO_2.H_2O$ | 8.75 | 0.083 |

(With an effective amount of Phosphate, $Na_2HPO_4.7H_2O$ to achieve proper performance)

It was known that the plating kinetics and film properties are a function of the surface conditions of the substrate as well as of the structure of the doublelayer across the interface. Further, it was known that the magnetic properties of Co-P films are a complicated function of phosphorous content, crystalline size and thickness, which in turn are controlled by the plating variables, primarily bath formula, pH and temperature. Surface potential of the substrate during plating is directly determined by the nature of the interface and reflects the system as a whole. In this work, the surface potential of electroless Co-P plating was measured as a function of plating time. The potentiometer was connected directly to the Ni-P substrate and a reference electrode. It is basically an open-circuit potential as no current flows in the electroless plating process. As the reactions occur on the Ni-P substrate this potential varies. In order to minimize the potential (IR) drop in the solution, the reference electrode (Ag-AgCl) was put close to the substrate, with the distance being the same for all the measurements taken.

EXAMPLE 1

Figure 1:
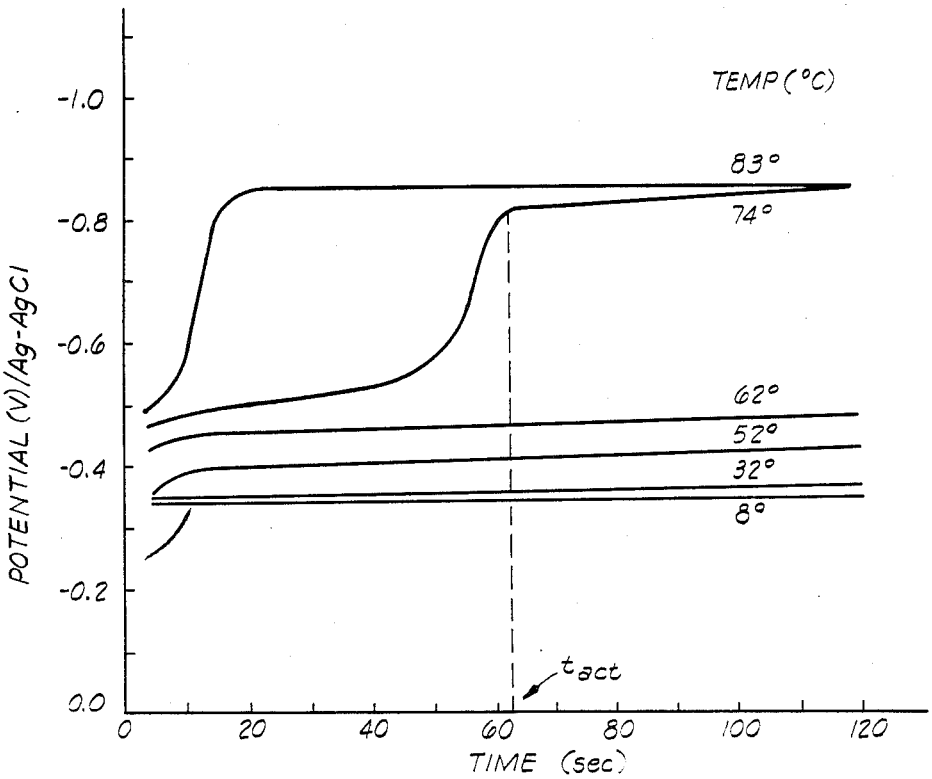
FIG. 1 is a graphic depiction of surface potential of electroless Co-P plating as a function of plating time and bath temperature.

Magnetic platings were performed on Ni-P substrates using the following procedures: (1) 3% $HNO_3$ pretreatment 15 sec; (2) Enbond NS-35 alkaline cleaner 3 min; (3) cobalt plating 90 sec; (4) the pH of the plating bath was adjusted by adding $NaOH/H_2SO_4$ to 8.05; (5) and the temperature for the runs was varied between 8° C. to 83° C. A deionized water spray rinse was applied between each of the pretreatment step. Magnetic platings were performed by the above procedures, unless otherwise stated. The magnetic properties, coercivity $H_c$ and remanencethickness product $B_r$-t, of the plated films were measured with a vibrating sample magnetometer (VSM). The results of the data are shown in FIG. 1 with most data in FIG. 1 representing a minimum of two independent runs, with the average taken to make the plots.

Surface potential for the electroless Co-P was measured during the magnetic plating using a Ag-AgCl electrode as a reference. Surface potential transients at different temperatures are presented in FIG. 1. At 74° C., it was found that the surface potential jumped after a certain time to a final steady value. The same is true for higher temperatures except that the jumping in surface potential occurred earlier. It is interesting to note that the final steady state surface potentials are the same, −0.85V, and that the films showed magnetics only after the surface potential rises. The time required for the surface potential to rise is herein designated as the activation or nucleation time ($t_{act}$) of the deposits and is affected by the surface conditions of the substrate, as will become clear hereinbelow.

EXAMPLE 2

Magnetic plating runs were performed as described in Example 1 with the exception that the temperature of the plating bath was held at 72° C., and the pretreatment of the substrate samples was varied between the following:

| | | |
|---|---|---|
| a. | 3 percent $HNO_3$ | 15 seconds |
| | Enbond NS-35 | 3 minutes |
| | 30 percent HCl | 3 minutes |
| b. | 3 percent $HNO_3$ | 15 seconds |
| | Enbond NS-35 | 3 minutes |
| | 1 M NaOH | 3 minutes |
| c. | 3 percent $HNO_3$ | 15 seconds |
| | Enbond NS-35 | 3 minutes |

Figure 2:
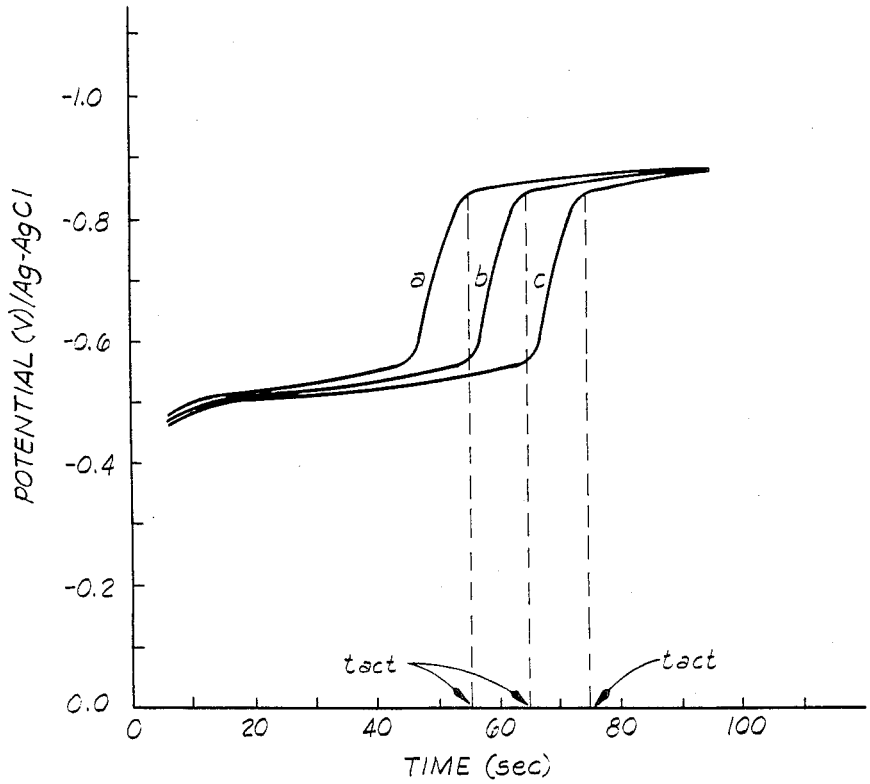
FIG. 2 is a graphic depiction of surface potential of Co-P plating as a function of plating time and varying pretreatments.

Deionized water spray rinse was applied between each pretreatment step. The results are shown in FIG. 2, and the effect of varying the pretreatment is evident. The temperature of the plating bath was 72° C. for each of the runs. The data tells one that the HCl pretreatment (curve a) was active more quickly than the other pretreatments (curves b and c).

The activation time, reflected in FIG. 2., varied considerably. For HCl pretreatment (curve a), the activation time ($t_{act}$) was approximately 55 seconds; for NaoH pretreatment (curve b), $t_{act}$ was approximately 65 seconds; and for regular $HNO_3$/Enbond pretreatment, $t_{act}$ was approximately 75 seconds.

EXAMPLE 3

Magnetic plating runs were performed as described in Example 1 hereinabove with the exception that the pH of the plating bath was varied for a plating bath at a temperature of 85° C.

Figure 3:
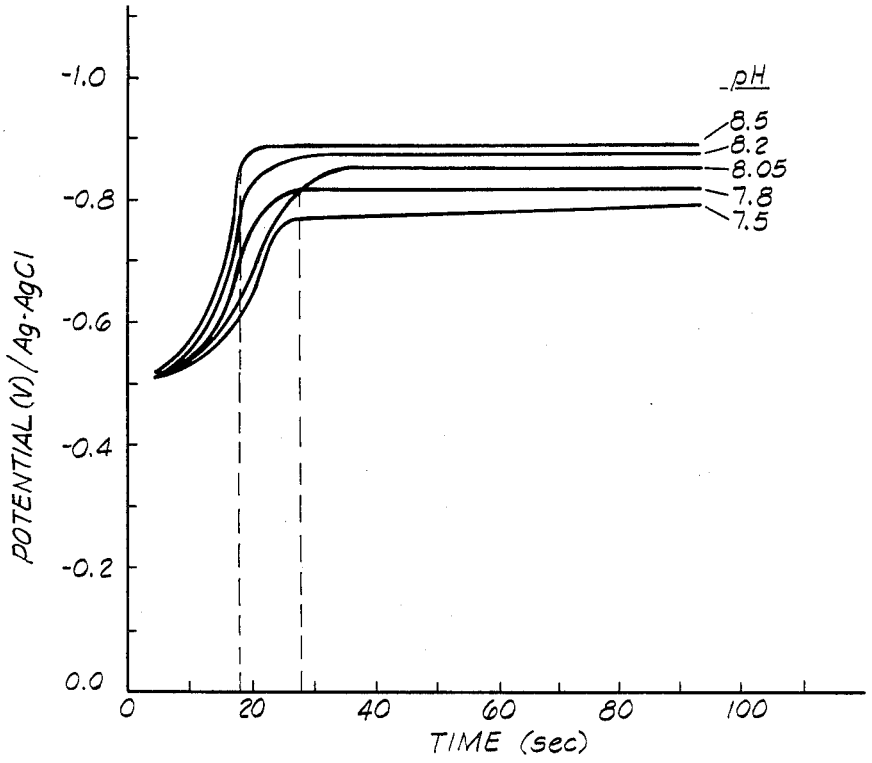
FIG. 3 is a graphic depiction of surface potential of Co-P plating as a function of plating time and varying pH of the plating bath.

The data demonstrates that the activation time, which fell within a very narrow band of between about 18 to 28 seconds, is somewhat insensitive to pH adjustment at the constant temperature investigated. However, the increase in pH values tends to drift the surface potential upwardly on the negative ordinate of FIG. 3 (greater absolute value at a negative potential); reviewed in reverse, the final steady state potential changes to the positive direction as the pH decreases.

It is interesting to note that while the temperature greatly affects the activation time but not the final steady potential, the solution pH changes the steady potential quite a lot but not the activation time.

Figure 4:
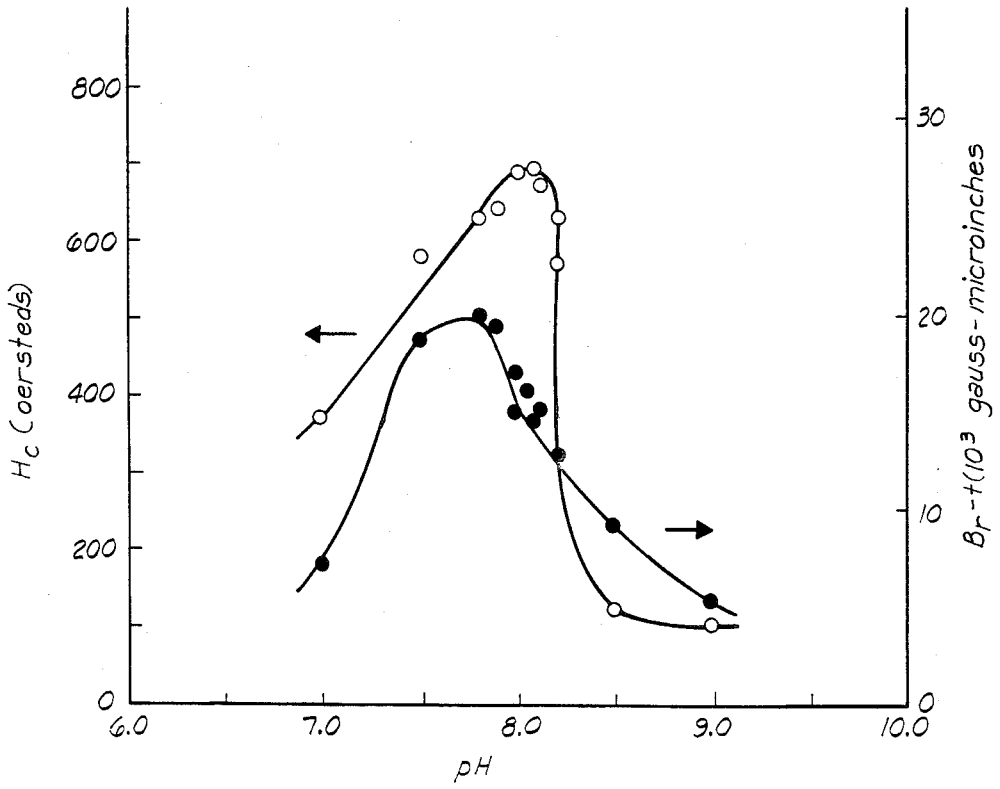
FIG. 4 is a graphic depiction of the dependence of $H_c$ and $B_r$-t for Co-P plating as a function of plating bath pH.

The dependence of the magnetic properties on pH in this example is shown in FIG. 4. As the pH of the solution is increased from 7.0 the coercivity starts to increase until the pH reaches 8.1, when $H_c$ starts to drop rapidly. It is known that the nucleation and growth process are very different from low pH to those at high pH. Grain size decreases with increasing pH, and this continues until ultimately the superparamagnetic range is approached with very small grains.

EXAMPLE 4

Magnetic plating runs were performed as described in Example 1 hereinabove with the exception that agitation of the plating bath was varied. The temperature of the plating bath was a constant 83° C.

Figure 5:
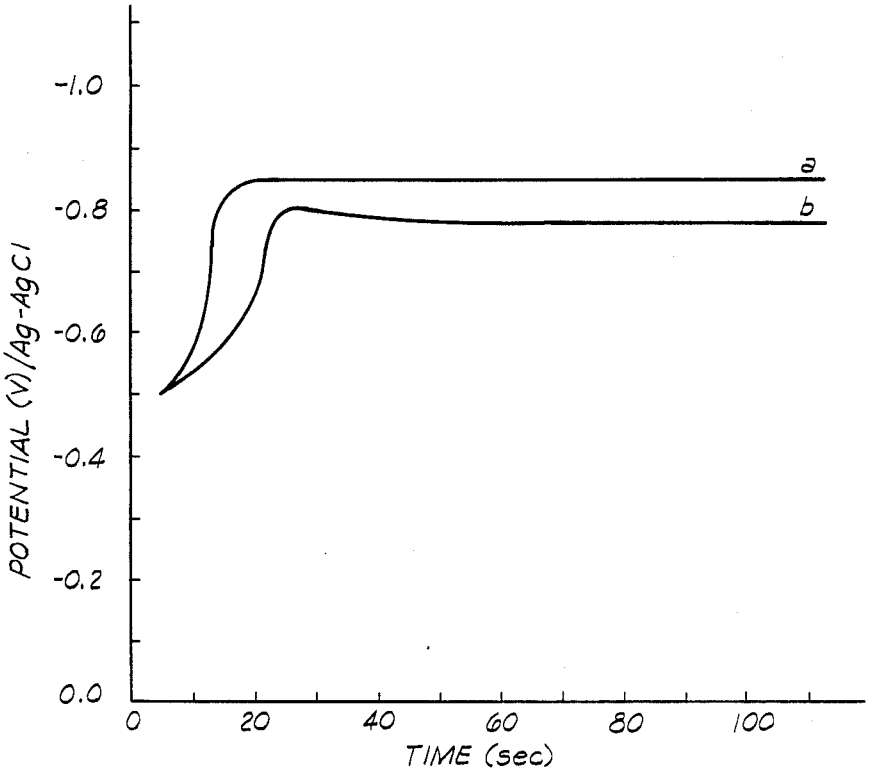
FIG. 5 is a graphic depiction of surface potential of electroless Co-P plating (a) without ultrasonic agitation, and (b) with ultrasonic agitation.

FIG. 5 shows the effect of ultrasonic agitation of the plating bath versus that achieved without agitation. The ultrasonic equipment used was a Bransonic Ultrasonic Cleaner No. 220, 50/60 Hz, 117 volts, 125 watts.

Curve a in FIG. 5 represents the data taken in a bath having no ultrasonic agitation. Curve b is the same bath with ultrasonic agitation.

Agitation is commonly used in the plating of metals. It has been used to decrease the concentration polarization with resulting finer grained deposits at higher plating rates. Agitation is also useful in preventing solution stratification and gas streaking. Among other advantages, improving smoothness and uniformity of the deposits are important. Ultrasonic agitation on electroless plating was studied for both basic and practical purposes. It is known that the application of ultrasonic energy during the plating process can be beneficial in achieving hardness, as significant changes in microstructure of the Ni-P deposits have been reported in the literature. Also, deposits of Ni-P formed with ultrasound agitation has a lower phosphorous content.

The plated film at 90 seconds of plating that was formed by curve b (with ultrasonic agitation) was analyzed, as was the plated film of curve a, and it was found that higher $B_r$-t and lower $H_c$ was experienced with the agitated bath. To be more exact, about 61 percent increase (16,725 to 26,984 Gauss-microinch) in $B_r$-t is ascribed to faster plating kinetics with agitation. However, the approximately 67 percent (653 to 216 $O_e$) decrease in $H_c$ is believed to be either the change in microstructure or less phosphorous in the plated film.

EXAMPLE 5

Magnetic plating runs were made using the same plating bath and pretreatments of Example 1, except for the pH and bath temperature settings. The results of the $B_r$-t measurements were analyzed as functions of both total (or apparent) plating time and true plating time as calculated from:

$$t_{tr}=t_t-t_{act}$$

where $t_{tr}$ is the true plating time, $t_t$ is the total (or apparent) plating time, and $t_{act}$ is the activation time.

The data was analyzed with the $B_r$-t values as a function of the apparent plating time and the true plating time. The results are shown in FIGS. 6A and 6B. These figures show that only the true plating time need be taken into account in the control of the magnetic plating of the Co-P deposition film.

In summary, the surface potential for electroless Co-P plating on a Ni-P substrate was measured during the magnetic plating using a Ag-AgCl reference electrode. The transient potential of the electroless Co-P plating process jumped to a final steady value after a certain time (activation time) and the films showed magnetic quality only after this potential jump. Thus, the time for the potential jump can be obtained by monitoring the surface potential. The true magnetic plating time ($t_{tr}$) is equal to the actual time, ($t_t$) minus the activation time ($t_{act}$) which is sensitive to the surface conditions.

Furthermore, the data presented in FIGS. 6A and 6B show that a narrower distribution of $B_r$-t values was obtained in FIG. 6B over that of FIG. 6A. The plating runs for FIG. 6B were controlled by determining the true plating time from the time that the surface potential jump occurred.

EXAMPLE 7

Figure 7A:
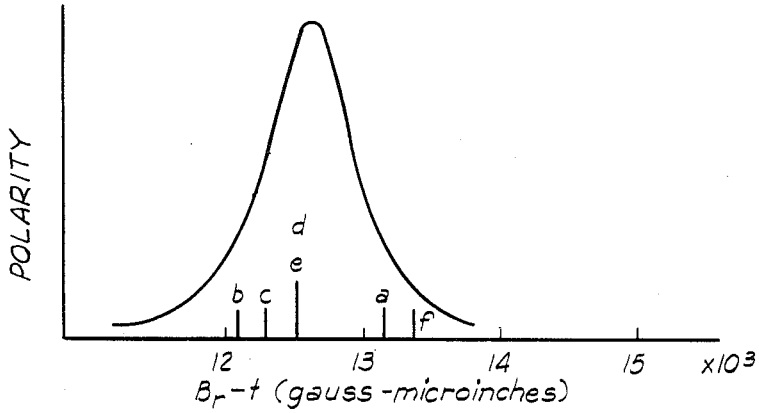
Figure 7B:
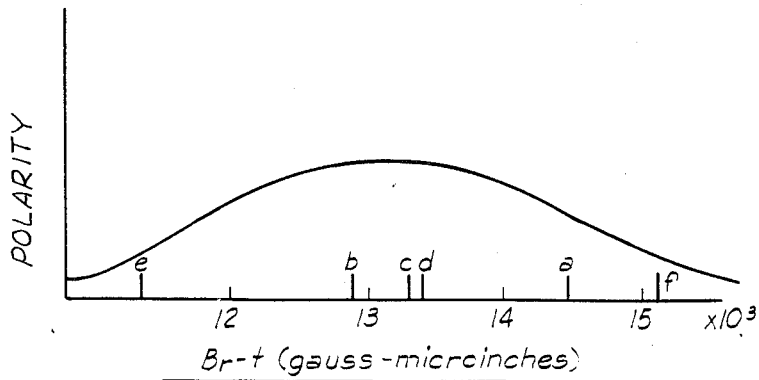
FIG. 7B is similar except that no interconnection of the samples was made.
Figure 5B:
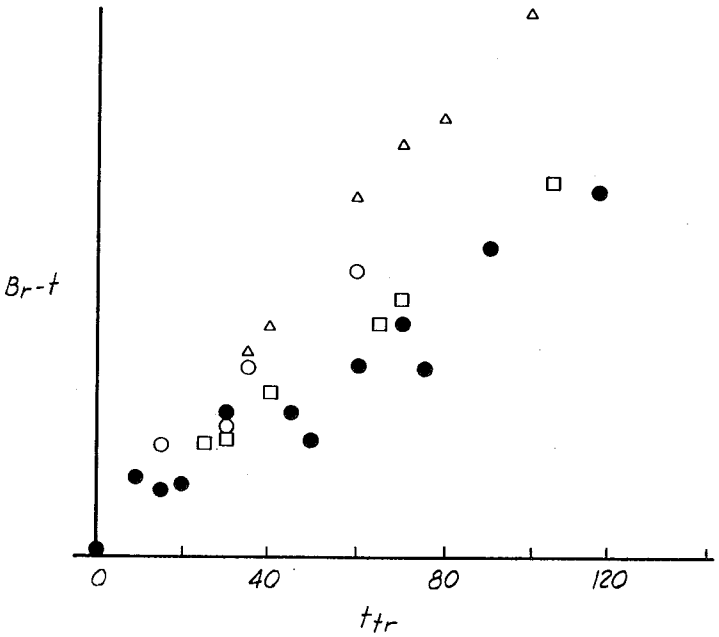
Figure 5A:
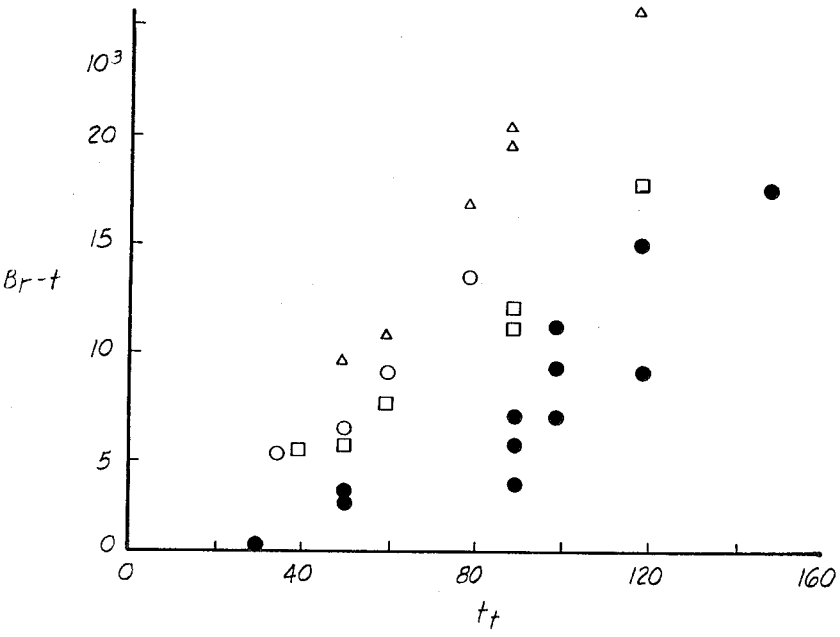

Magnetic runs were conducted using 6 substrates in the plating bath described in Table 1. It was believed that the potentials of all the disks to be plated would be identical if all the disks are connected together during plating. A special holder was made so that all of the substrates could be joined in parallel electrical interconnection or separated. The pretreatment for the substrates were as follows:

(a) 3% $HNO_3$, 15 sec
(b) 3% $HNO_3$, 1 min
(c) 3% $HNO_3$, 15 sec+alkaline NS-35, 30 sec
(d) 3% $HNO_3$, 15 sec+alkaline NS-35, 1 min
(e) 30% HCl dipping
(f) none Identical plating runs were made on substrate sets, first electrically interconnected, and second, in separated spaced apart juxtaposition. The results of these runs are shown in FIG. 7A (in which the substrates were electrically interconnected during plating) and FIG. 7B (in which the substrates were not connected). The graphs reflect polarity distribution versus remanencethickness product as taken from a B-H loop measured by VSM.

Although the individual surface conditions were different, the conductive influence of surface potential equalized on all the surfaces. A narrower yield distribution within the group was achieved by simply connecting the disks (FIG. 7A) and monitoring the true plating time by monitoring the potential jump.

The above examples illustrate the important findings of the present invention. That is, that narrower yield distribution is obtained in electroless magnetic plating if the plating time is offset by the activation time and relying upon the true plating time only. It is known that the difficulty in yield control is the great variation encountered in substrate surface conditions. By measuring the transient potential and regulating the magnetic plating process by true plating time, one is able to minimize these influences.

The present invention relates to the process control of electroless plating baths by monitoring the surface potential, and more precisely, to narrowing the yield distribution of deposited magnetic films. This potential transient is a unique phenomena in electroless plating and has not been considered before. It is clear that the present invention is well adapted to carry out the objects and to attain the ends and advantages mentioned herein as well as those inherent in the invention. While a presently preferred embodiment of the invention has been described for the purposes of this disclosure, numerous changes may be made which will readily suggest themselves to those skilled in the art and which are encompassed within the spirit of the invention disclosed and as defined in the appended claims.

I claim:

1. An improved method for controlling an electroless plating bath to control the magnetic quality of the deposited film on a selected substrate, the method comprising the steps of:

(a) measuring the surface potential of the plating substrate;
(b) determining the activation time for the surface potential to increase a final steaady value; and
(c) subjecting the substrate to a true plating time calculated by the formula: $t_{tr}$ equals $t_t$ less $t_{act}$, where $t_{tr}$ is true plating time, $t_t$ is the total plating time, and $t_{act}$ is the activation time.

2. The method of claim 1 wherein the electroless plating bath is one which deposits a selected Co-P deposition film.

3. The method of claim 2 wherein a plurality of substrates are plated simultaneously and wherein such substrates are electrically interconnected.

4. The method of claim 3 wherein the activation time is predetermined and subsequent substrates are plated by the steps of:

(d) monitoring the plating to determine when the surface potential has jumped; and (e) subjecting the substrates to plating for the true plating time.

5. An improved method for controlling an electroless plating bath to control the magnetic quality of the deposited film on a selected substrate, the method comprising the steps of:

plating the substrate in an electroless plating bath;

determining the activation time for the transient potentials to decrease and for steady state surface potential to occur for the substrate being plated; and continuing the plating of the substrate for predetermined true plating time extending beyond the determined activation time.

* * * * *

UNITED STATES PATENT AND TRADEMARK OFFICE

CERTIFICATE OF CORRECTION

PATENT NO. : 4,810,520

DATED : March 7, 1989

INVENTOR(S) : Cherng-Dean Wu

It is certified that error appears in the above-identified patent and that said Letters Patent is hereby corrected as shown below:

Column 1, line 51, after "temperature.", delete "perature.";

Column 1, line 64, change "steddy" to --steady--;

Column 3, line 43, change "remanencethickness" to --remanence-thickness--;

Column 5, line 32, change "$1t_{tr} = t_t - t_{act}$" to --(1) $t_{tr} = t_t - t_{act}$--;

Column 6, lines 13 and 14, change "remanencethickness" to --remanence-thickness--; and Column 6, line 55 (claim 1), change "potential to increase a final steaady value; and" to --potential to increase to a final steady value; and--.

Signed and Sealed this

Thirteenth Day of November, 1990

*Attest:*

HARRY F. MANBECK, JR.

*Attesting Officer*

*Commissioner of Patents and Trademarks*